US011217417B2

(12) United States Patent
Smith et al.

(10) Patent No.: US 11,217,417 B2
(45) Date of Patent: Jan. 4, 2022

(54) SELF-ALIGNED ELECTROSPRAY DEVICE AND RELATED MANUFACTURING TECHNIQUES

(71) Applicant: Massachusetts Institute of Technology, Cambridge, MA (US)

(72) Inventors: Melissa A. Smith, Cambridge, MA (US); Donna-Ruth W. Yost, Acton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 16/872,776

(22) Filed: May 12, 2020

(65) Prior Publication Data

US 2020/0395186 A1 Dec. 17, 2020

Related U.S. Application Data

(60) Provisional application No. 62/846,946, filed on May 13, 2019.

(51) Int. Cl.

| | |
|---|---|
| ***H01J 3/04*** | (2006.01) |
| ***H01J 9/02*** | (2006.01) |
| ***H01J 27/26*** | (2006.01) |

(52) U.S. Cl.

CPC *H01J 3/04* (2013.01); *H01J 9/02* (2013.01); *H01J 27/26* (2013.01); *H01J 2209/012* (2013.01)

(58) Field of Classification Search

None

See application file for complete search history.

(56) References Cited

U.S. PATENT DOCUMENTS

| | | | | |
|---|---|---|---|---|
| 2002/0000516 | A1 | 1/2002 | Shultz et al. | |
| 2002/0123153 | A1 | 9/2002 | Moon et al. | |
| 2009/0056133 | A1 | 3/2009 | Waits et al. | |
| 2011/0192968 | A1 | 8/2011 | Makarov et al. | |
| 2013/0287962 | A1* | 10/2013 | Deng | B05B 5/0255 427/458 |
| 2020/0378371 | A1* | 12/2020 | Lozano | F03H 1/0012 |

OTHER PUBLICATIONS

PCT Invitation to Pay Additional Fees dated Aug. 3, 2020 for International Application No. PCT/US2020/032465; 2 Pages.

(Continued)

*Primary Examiner* — Ashok Patel

(74) *Attorney, Agent, or Firm* — Daley, Crowley, Mofford & Durkee, LLP

(57) ABSTRACT

In some embodiments, a self-aligned electrospray device can include a silicon wafer, a fluid reservoir, and a circuit. The silicon wafer can have a layer of electrically insulating material deposited on a top surface and a deposited layer of electrically conducting material. The silicon wafer and the deposited layers can have through holes. The electrically insulating layer may be undercut. The fluid reservoir can be mounted to a bottom surface of the silicon wafer for containing fluid. The circuit can provide an electric potential difference and be coupled between the layer of electrically conducting material and the fluid reservoir.

6 Claims, 6 Drawing Sheets

(56) References Cited

OTHER PUBLICATIONS

PCT International Search Report and Written Opinion dated Oct. 6, 2020 for International Application No. PCT/US2020/032465; 12 Pages.
Kim, et al., "Miniaturized Multichannel Electrospray Ionization Emittters on Poly(dimethylsiloxane) Microfluidic Devices;" Electrophoresis; Oct. 15, 2001; 7 pages.
'Pyrex' Wikipedia; Downloaded from https://en.wikipedia.org/wiki/Pyrex on Jun. 24, 2020; 5 pages.
Paine, et al., "A Micro-Fabricated Colloidal Thruster Array;" 37$^{th}$ AIAA/ASME/SAE/ASEE Joint Propulsion Conference and Exhibit; Jul. 8, 2001; 10 Pages.
Paine, et al., "Realisation of Very High Voltage Electrode-Nozzle Systems for MEMS;" Sensors and Actuators; Mar. 28, 2004; 6 Pages.
Takao, et al., "Microfabrication of a Massive Emitter Array for Higher Thrust Density of Ionic Liquid Electrospray Thrusters;" The 35$^{th}$ International Electric Propulsion Conference; Oct. 8, 2017; 7 Pages.
Velasquez-Garcia, et al., "A Micro-Fabricated Linear Array of Electrospray Emitters for Thruster Applications;" Journal of Microelectromechanical Systems, vol. 15, No. 5; Oct. 2006; 13 Pages.

* cited by examiner

SELF-ALIGNED ELECTROSPRAY DEVICE AND RELATED MANUFACTURING TECHNIQUES

CROSS-REFERENCE TO RELATED APPLICATIONS

This application claims the benefit under 35 U.S.C. § 119 of provisional patent application No. 62/846,946 filed May 13, 2019, which is hereby incorporated by reference herein in its entirety.

GOVERNMENT LICENSE RIGHTS

This invention was made with Government support under Grant No. FA8702-15-D-0001 awarded by the U.S. Air Force. The Government has certain rights in the invention.

BACKGROUND

Electrosprays are aerosols of charged particles (droplets, or ions) that are electrostatically extracted from an electrically conductive liquid. As shown in FIG. 1, an electrospray device 100 can include an array of emitters 110*a*, 110*b*, etc. (110 generally) and an extractor 106. Emitters 110 provide the source of the ions, generally as holes in a fluid reservoir or tank 102, and are electrically isolated from the extractor 106. The extractor 106 is electrically conductive and contains holes or apertures 112*a*, 112*b*, etc. For proper operation of the device 100, each emitters 110*a*, 110*b*, etc. must be aligned with a respective one of the apertures 112*a*, 112*b*, etc. Applying an electric potential between the extractor 106 and a conductive fluid 120 in the reservoir 102 causes a Taylor cone 122 to form in the space between the extractor 106 and each emitter 110 so that ions exit each aperture 112 as an aerosol.

Microfabricated electrospray devices are used in many fields, including, among others: chemical and biochemical analysis for mass spectrometry, focused ion beam instruments (as a liquid metal ion source), low thrust electric propulsion (e.g. satellite propulsion), deposition instruments for nanoscale structures (e.g. textiles, highly porous drug carriers, and nebulizers), and ambient atmospheric charge neutralizers.

Existing microfabricated electrospray devices are formed as microelectromechanical systems (MEMS) using appropriate techniques known in the art. These systems include the fluid reservoir and emitters on one wafer, and the extractor with apertures on another wafer, where the two wafers are carefully bonded, so the emitters and apertures align.

SUMMARY OF DISCLOSED EMBODIMENTS

As shown in FIG. 1, with existing electrospray devices 100 and manufacturing techniques, it is common for misalignment of apertures 112 and emitters 110 to occur causing aerosol to be physically intercepted by the device, reducing the efficiency of the device or even rendering it inoperable. For example, misalignment between a first aperture 112*a* and a corresponding first emitter 110*a* can cause aerosol 122 to be physically intercepted by an underside of extractor 106, as illustrated in FIG. 1.

Disclosed embodiments avoid misalignment by providing self-aligning electrospray devices, in which the fabrication technique ensures that emitters are precisely aligned with extractor apertures.

Thus, a first embodiment is a self-aligned electrospray device. The device includes a silicon wafer that provides the emitters. The silicon waver has, deposited on a top surface thereof, a layer of electrically insulating material the provides a physical gap between the emitters and the extractor. Deposited thereon is a layer of electrically conducting material, which provides the extractor. The silicon wafer and the deposited layers have openings or through-holes provided therein to permit passage of the aerosol, and the electrically insulating layer is undercut to promote formation of a Taylor cone. The device further includes a fluid reservoir, coupled to a bottom surface of the silicon wafer, for containing fluid. The device also includes a circuit, for providing an electric potential difference, coupled between the layer of electrically conducting material and the fluid reservoir.

A second embodiment is a method of making a self-aligned electrospray device. The method includes forming a silicon wafer having deposited or otherwise disposed on a first or top surface thereof a layer of electrically insulating material. A layer of electrically conducting material is deposited or otherwise disposed on the electrically insulating material. The silicon wafer and the deposited layers have through holes. The method next includes undercutting the electrically insulating material. The method then includes mounting or otherwise coupling a bottom surface of the silicon wafer to a fluid reservoir for containing fluid. The method further includes providing a circuit, for providing an electric potential difference, between the layer of electrically conducting material and the fluid reservoir.

In some embodiments, forming the silicon wafer and the deposited layers comprises using a Bosch (or Bosch-like) technique. Such embodiments include depositing, on the top surface of the silicon wafer, the layer of electrically insulating material; depositing, on the electrically insulating material, the layer of electrically conducting material; depositing, on the layer of electrically conducting material, a layer of photoresist having an aperture pattern; etching the aperture pattern through the deposited layers; etching the silicon wafer using a Bosch process to expose emitters that are each self-aligned with a corresponding aperture in the pattern; and thinning the silicon wafer to expose the emitters as the bottom surface of the silicon wafer.

In some embodiments, forming the silicon wafer and the deposited layers comprises using a metal-assisted chemical etching (MACE) technique. Such embodiments include depositing, on the top surface of the silicon wafer, the layer of electrically insulating material; depositing, on the layer of electrically insulating material, a layer of photoresist having an aperture pattern; etching the aperture pattern through the deposited layer; depositing the layer of electrically conducting material on the etched surface; etching through the etched pattern using metal-assisted chemical etching; and thinning the silicon wafer through any residual electrically conducting material to expose the emitters as the bottom surface of the silicon wafer.

Some embodiments include, before thinning the silicon wafer, reducing diameters of one or more emitter holes using thermal oxidation or selective silicon-based epitaxy.

It is appreciated that other embodiments may form the required silicon wafer, electrically insulating layer, and electrically conducting layer using other techniques known in the art.

DESCRIPTION OF THE SEVERAL VIEWS OF THE DRAWINGS

The manner and process of making and using the disclosed embodiments may be appreciated by reference to the drawings.

DETAILED DESCRIPTION

Figure 1:
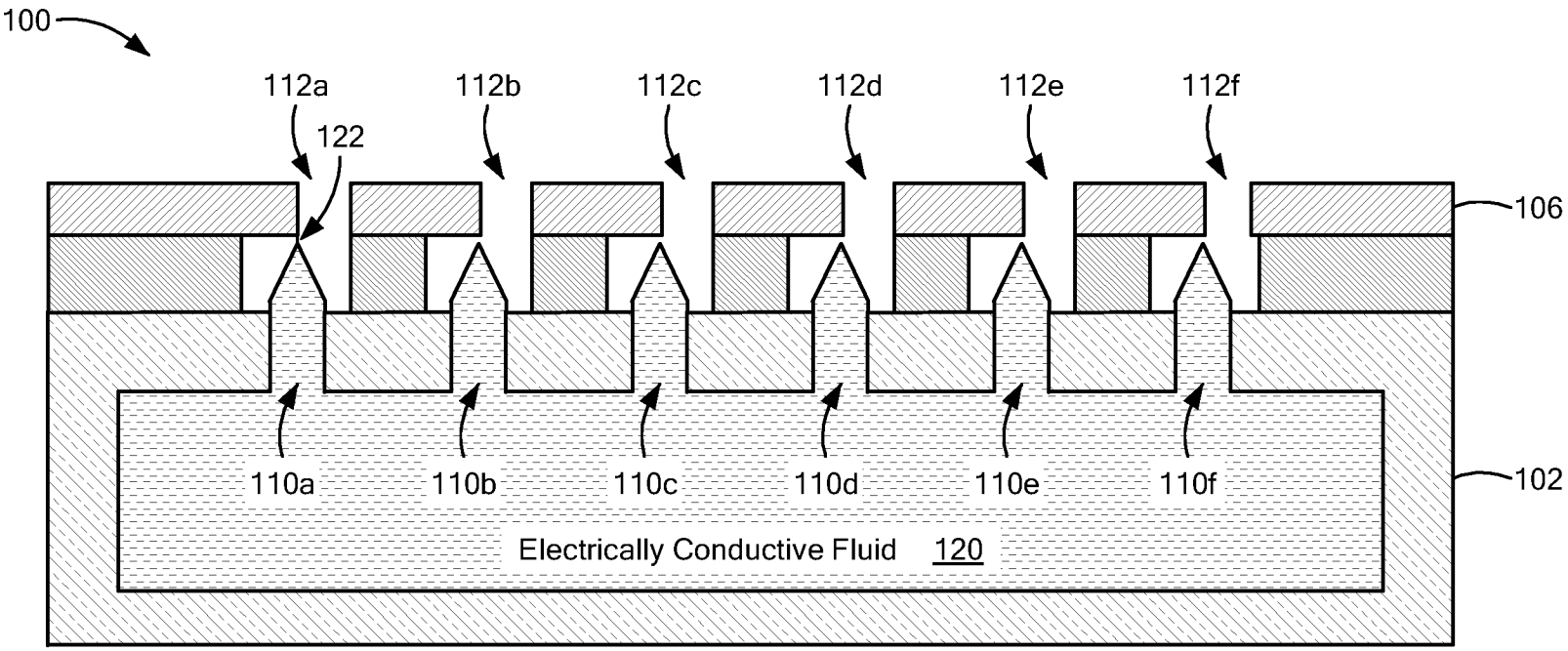
FIG. 1 (Prior Art)
FIG. 1 is a cross-sectional view of a prior art electrospray device having misaligned extractor apertures.

Before proceeding with a discussion of the concepts, systems, device, circuits and techniques described herein, some introductory concepts and terminology are first provided.

Various embodiments of the concepts systems and techniques are described herein with reference to the related drawings. Alternative embodiments can be devised without departing from the scope of the described concepts. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to element or structure "A" over element or structure "B" include situations in which one or more intermediate elements or structures (e.g., element "C") is between element "A" and element "B" regardless of whether the characteristics and functionalities of element "A" and element "B" are substantially changed by the intermediate element(s).

The following definitions and abbreviations are to be used for the interpretation of the claims and the specification.

As used herein, the terms "comprises," "comprising," "includes," "including," "has," "having," "contains" or "containing," or any other variation thereof, are intended to cover a non-exclusive inclusion. For example, a method, article, or apparatus that comprises a list of elements is not necessarily limited to only those elements but can include other elements not expressly listed or inherent to such method, article, or apparatus.

Additionally, the term "exemplary" is used herein to mean "serving as an example, instance, or illustration." Any embodiment or design described herein as "exemplary" is not necessarily to be construed as preferred or advantageous over other embodiments or designs. The terms "one or more" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

References in the specification to "one embodiment," "an embodiment," "an example embodiment," or variants of such phrases indicate that the embodiment described can include a particular feature, structure, or characteristic, but every embodiment can include the particular feature, structure, or characteristic. Moreover, such phrases are not necessarily referring to the same embodiment. Further, when a particular feature, structure, or characteristic is described in connection knowledge of one skilled in the art to affect such feature, structure, or characteristic in connection with other embodiments whether or not explicitly described.

Furthermore, it should be appreciated that relative, directional or reference terms (e.g. such as "above," "below," "left," "right," "top," "bottom," "vertical," "horizontal," "front," "back," "rearward," "forward," etc.) and derivatives thereof are used only to promote clarity in the description of the figures. Such terms are not intended as, and should not be construed as, limiting. Such terms may simply be used to facilitate discussion of the drawings and may be used, where applicable, to promote clarity of description when dealing with relative relationships, particularly with respect to the illustrated embodiments. Such terms are not, however, intended to imply absolute relationships, positions, and/or orientations. For example, with respect to an object or structure, an "upper" surface can become a "lower" surface simply by turning the object over. Nevertheless, it is still the same surface and the object remains the same. Also, as used herein, "and/or" means "and" or "or", as well as "and" and "or." Moreover, all patent and non-patent literature cited herein is hereby incorporated by references in their entirety.

The terms "disposed over," "overlying," "atop," "on top," "positioned on" or "positioned atop" mean that a first element, such as a first structure, is present on a second element, such as a second structure, where intervening elements or structures (such as an interface structure) may or may not be present between the first element and the second element. The term "direct contact" means that a first element, such as a first structure, and a second element, such as a second structure, are connected without any intermediary elements or structures between the interface of the two elements.

Figure 2:
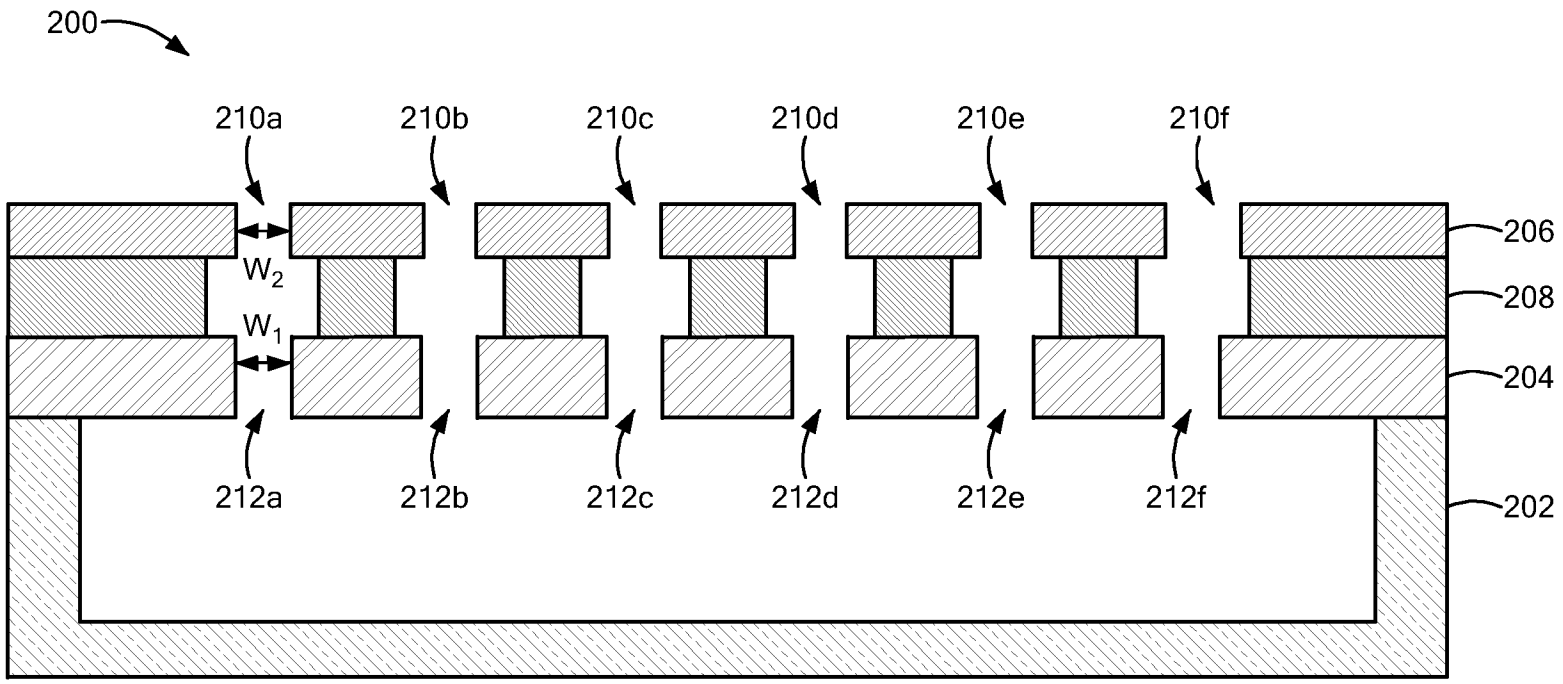
FIG. 2 is a cross-sectional view of a self-aligned electrospray device, according to some embodiments.

FIG. 2 shows a self-aligned electrospray device, according to some embodiments. The illustrative self-aligned electrospray device 200 includes a fluid reservoir 202, an emitter substrate 204 disposed over the reservoir 202, an extractor 206, and an insulation layer 208 disposed between the substrate 204 and the extractor 206. An array of emitters 212*a*, 212*b*, etc. (212 generally) provide a pathway for fluid to exit the fluid reservoir 202. An array of apertures 210*a*, 210*b*, etc. (210 generally) may be formed in the extractor 206, providing a pathway for fluid to exit the device. Insulation layer 208 provides electrical isolation between each emitter 212 the extractor 206. While five emitters 212*a*-212*f* are shown in the example of FIG. 2, the disclosed subject matter can be applied to devices having an arbitrary number of emitters 212.

In embodiments, the array of emitters 212 may be formed from a silicon wafer. That is, emitter substrate 204 in FIG. 2 may be provided as a silicon wafer. The insulation layer 208 may be formed from an electrically insulating material that is deposited on a top surface of the silicon wafer. Such insulating materials may include, for example, oxides such as $SiO_2$, nitrides such as SiN, and polymers such as Teflon or Kapton. The extractor 206 may be formed from an electrically conducting material that is deposited on a top surface of the insulation layer 208. Such electrically conducting material may include, for example, metals such as Aluminium (Al), Tungsten (W), Gold (Au), Chromium (Cr), Molybdenum (Mo), or Copper (Cu); heavy doped semiconductors such as p++ or n++ type Silicon (Si); or conducting oxides such as indium tin oxide.

In some embodiments, an emitter 212 can have a diameter or width $W_1$ of approximately 500 nm. In some embodiments, an aperture 210 can have a diameter or width $W_2$ of approximately 600 nm. In some embodiments, $W_2$ can be about 20% larger than $W_1$ (e.g., $W_2$ can be between 15% and 25% larger than $W_1$).

Figure 2A:
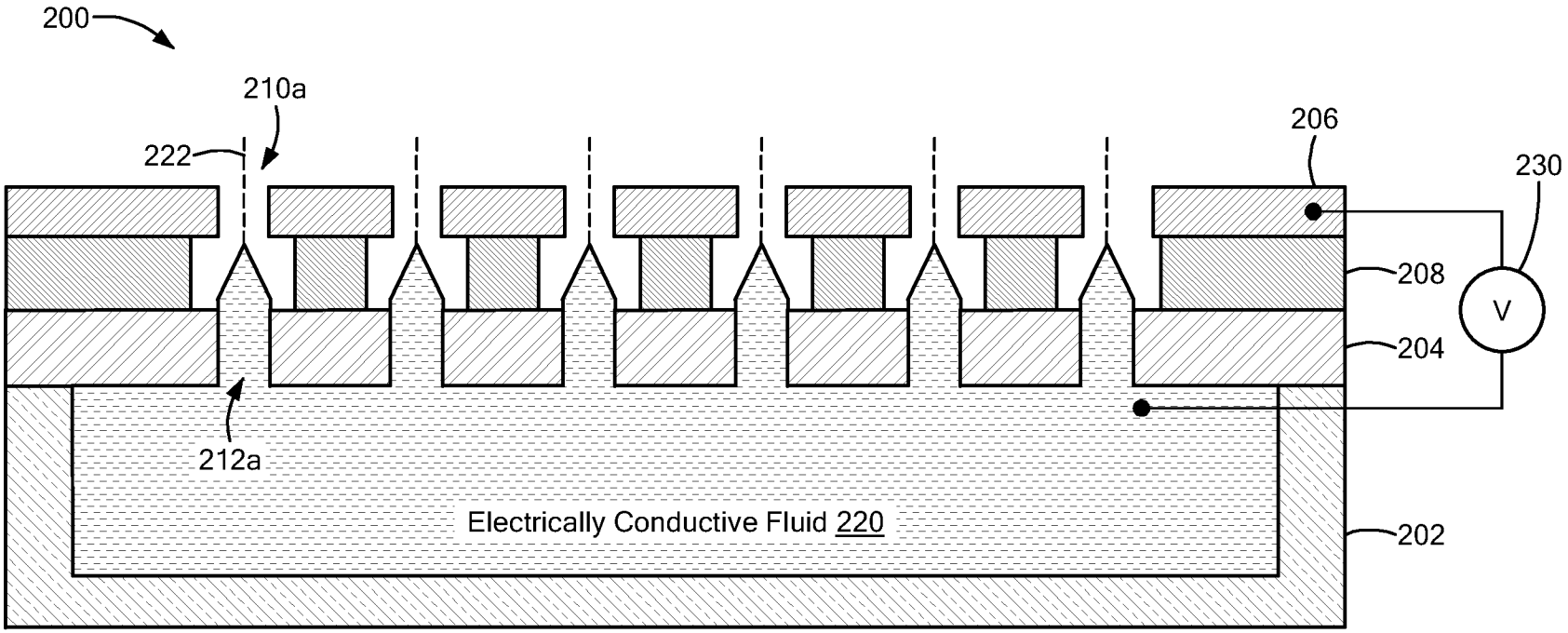
FIG. 2A is a cross-sectional view of a self-aligned electrospray device including a circuit for providing an electric potential difference between the extractor and fluid in the fluid reservoir, according to some embodiments.

Referring to FIG. 2A in which like elements of FIG. 2 are shown using like reference numbers, the self-aligned electrospray device 200 can include a circuit 230 for providing an electric potential difference between the extractor 206 and electrically conductive fluid 220 in fluid reservoir 202. The circuit 230 can be any voltage source in the range of approximately 1 kilovolt (kV) to tens of kV. The electric potential applied by circuit 230 can cause Taylor cones to form in the spaces between the extractor 206 and each emitter 212 (e.g., between extractor 206 and emitter 212*a*) so that ions exit each aperture as an aerosol (e.g., so that ions 222 exit aperture 210*a* as an aerosol).

Figure 3:
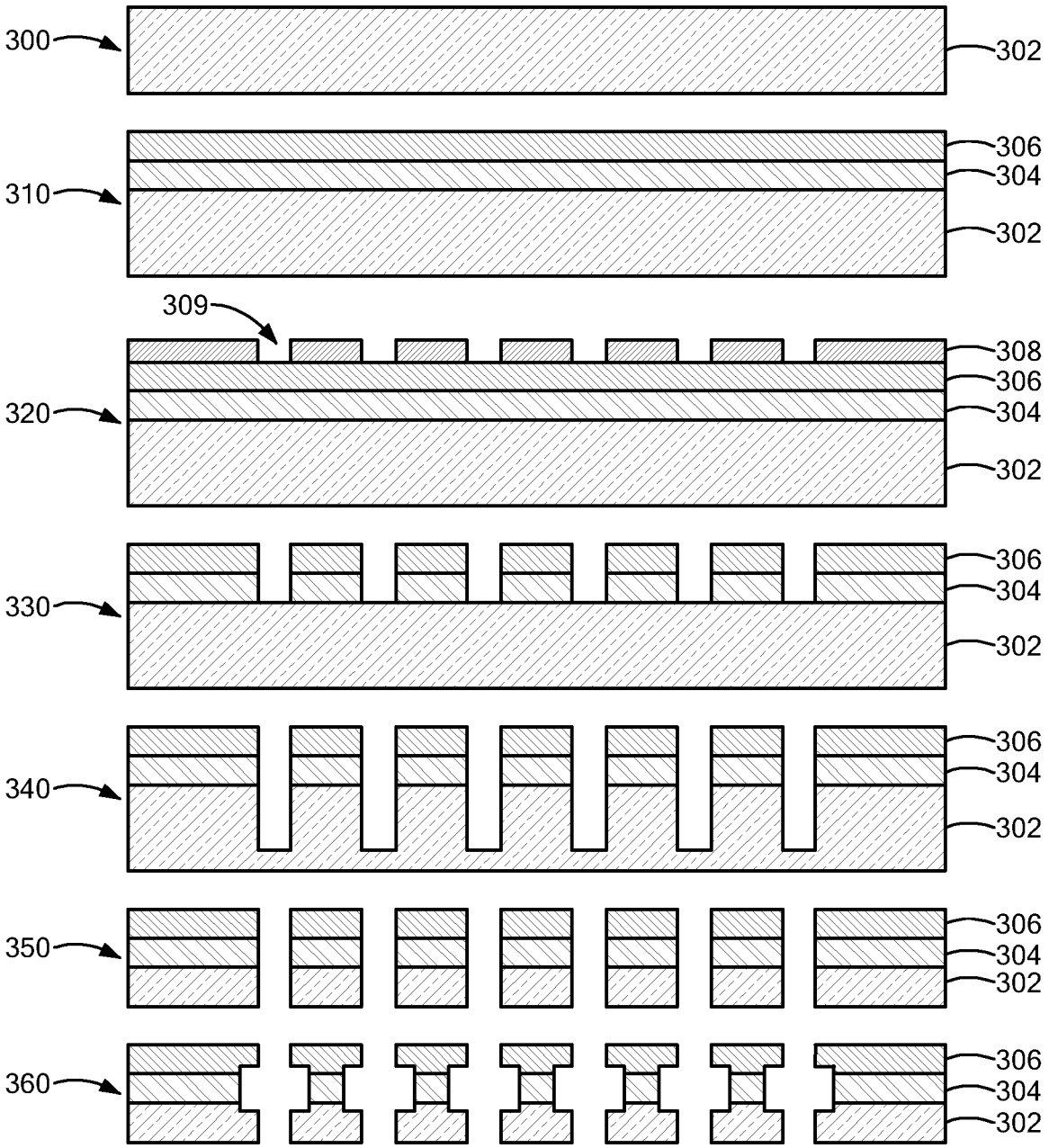
FIG. 3 is a series of cross-sectional views illustrating a process of making a self-aligned electrospray device which may be the same as or similar to the device illustrated in FIG. 2, according to some embodiments.

FIG. 3 shows a process, using the Bosch technique, of making a self-aligned electrospray device which may be the same as or similar to device 200 of FIG. 2.

Step 300 includes providing a silicon wafer 302 having a full thickness. The array of emitters of the device will be formed from a portion of this wafer. As used herein, "full thickness" refers to the thickness of wafer as manufactured. For example, if a 200 mm Si wafer is manufactured to be around 725 um thick, then its full thickness is 725 um. In some embodiments, wafer 302 has a full thickness in the range of 300 microns to 1 millimeter.

Step 310 includes depositing, on the top surface of a silicon wafer 302, a layer of electrically insulating material 304, which can include any of the electrically insulating materials described in connection with FIG. 2. In some embodiments, the insulating layer 304 can have a thickness that is sufficient to withstand an applied electric potential of 1000 kV without significant degradation. Step 310 can further include depositing, on a top surface of the electrically insulating material 304, a layer of electrically conducting material 306, which can include any of the electrically insulating materials described in connection with FIG. 2. The layer of electrically conducting material 306 will form the extractor. The materials 304 and 306 may be deposited or otherwise disposed on the insulating material using any technique known to those of ordinary skill in the art including but not limited to any additive or subtractive technique including but not limited to any sputtering or vapor deposition technique.

Step 320 includes depositing, on a top surface of the layer of electrically conducting material 306, a layer of photoresist 308 having an aperture pattern. The aperture pattern is indicated as holes (e.g., hole 309) in the layer of photoresist 308 that expose a top surface of the underlying electrode layer 306 for use in etching. Thus, in this illustrative embodiment, the apertures are formed using a patterning technique. Those of ordinary skill in the art will appreciate, of course, that any additive or subtractive technique may be used to form or otherwise provide the apertures.

Step 330 includes etching the aperture pattern through the deposited layers 306 and 304. The processing of step 330 may be performed, for example, using "dry" reactive ion etching (RIE) or using "wet" chemical etching.

Step 340 includes etching the silicon wafer 302 using a Bosch, or Bosch-like, process to expose emitters that are each self-aligned with a corresponding aperture in the pattern. As used herein, "Bosch-like process" refers to an etching that creates features having a relatively high aspect ratio; that is, a relatively high ratio between the depth of a hole and its diameter.

Step 350 includes thinning the silicon wafer 302 to expose the emitters as the bottom surface of the silicon wafer. The thinning processing step 350 is complete when the emitters are exposed. Any thinning technique known in the art may be employed.

In some embodiments, the bottom surface thus exposed may be coupled to a fluid reservoir (e.g. reservoir 202 of FIG. 2), so that the exposed bottom surface becomes the array of emitters (e.g., emitters 212 in FIG. 2). Such coupling may be accomplished via a bonding process or via any other process well known to those of ordinary skill in the art.

In some embodiments, prior to coupling the structure to a fluid reservoir, a processing step 360 can include undercutting the insulation layer 304 to provide space for the Taylor cone to form in the gap between each emitter and its corresponding extractor aperture. Undercutting may be performed, for example, by isotropically etching the insulation layer 304.

Figure 3A:
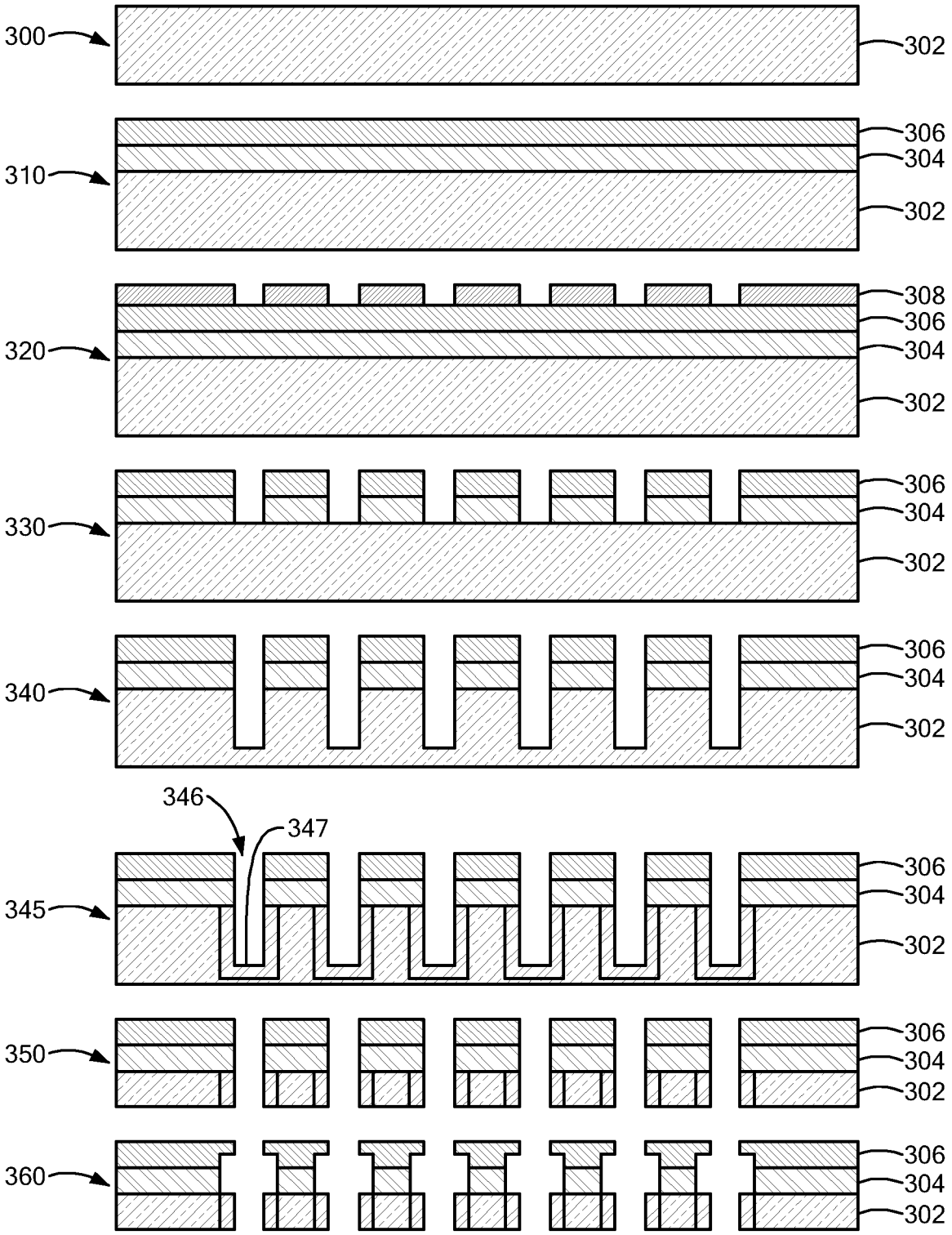
FIG. 3A is a series of cross-sectional views illustrating another process of making a self-aligned electrospray device which may be the same as or similar to the device illustrated in FIG. 2, according to some embodiments.

FIG. 3A shows another process making a self-aligned electrospray device which may be the same as or similar to device 200 of FIG. 2. The process shown in FIG. 3A is similar to that of FIG. 3 but for an optional, extra processing step 345.

Step 345 includes growing or otherwise providing a structure on the inside of the apertures to reduce the diameter of the eventual emitters. For example, as shown in FIG. 3A, a structure 347 may be provided along the bottom and insides of aperture 346. Structure 347 can be comprised of, for example, an oxide or a silicon-based epitaxy. To make the structure 347, a selective thermal oxidation process or a selective Si epitaxial process can be used to grow Si in the exposed Si in the emitters on the wafer. With both processes, the metal may be selected to be compatible with high temperature processing, such as W. In an embodiment using the extra processing step 345, the emitters may be narrower, so the aspect ratios of the through-holes in the self-aligned electrospray device are thereby increased. Aspect ratio here refers to the emitter length divided by diameter. In some embodiments, emitters can have an aspect ratios in the range of 300 to 400.

Figure 4:
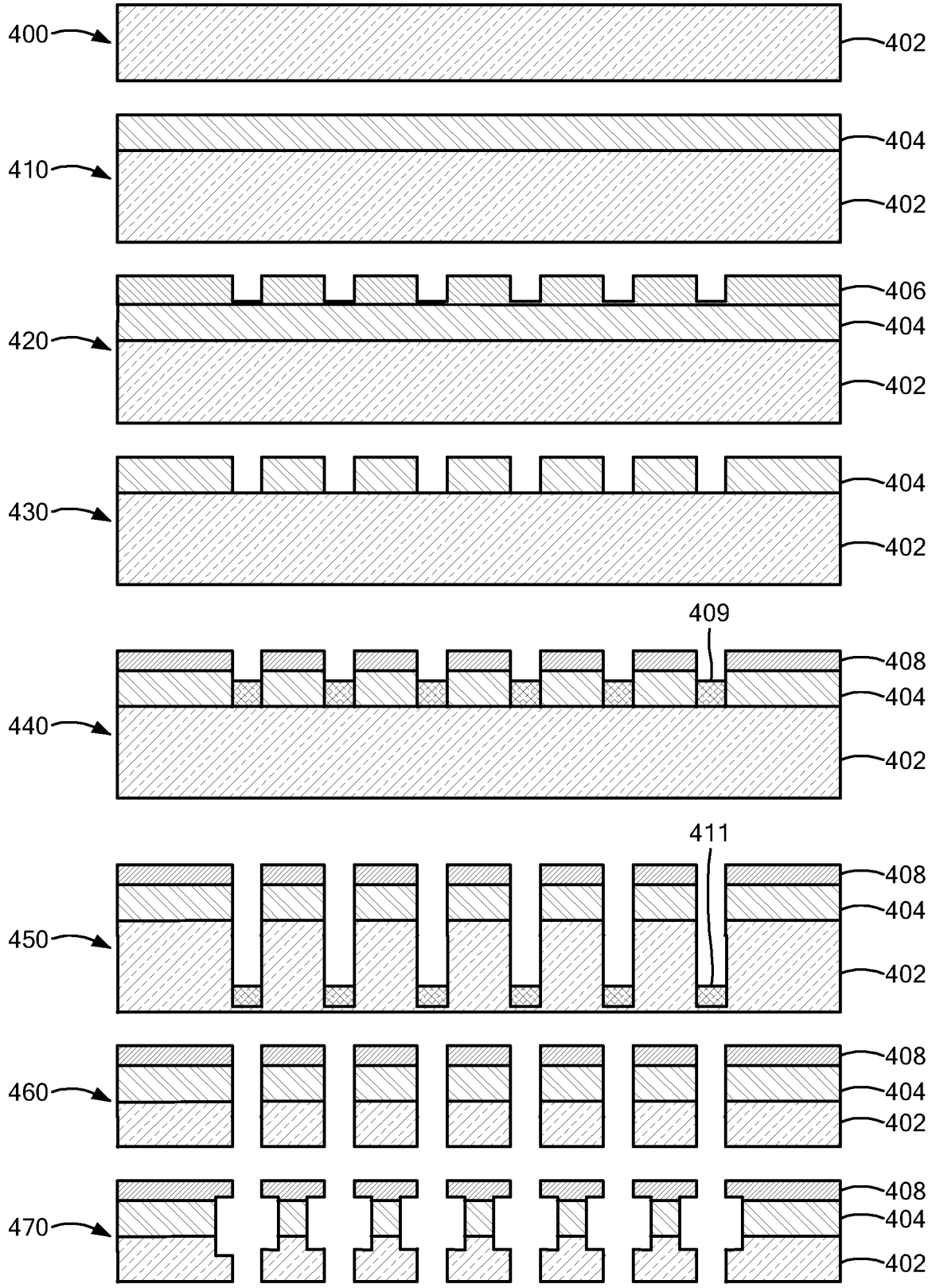
FIG. 4 is a series of cross-sectional views illustrating another process of making a self-aligned electrospray device which may be the same as or similar to the device illustrated in FIG. 2, according to some embodiments.

FIG. 4 shows another process, using a metal-assisted chemical etching (MACE) technique, of making a self-aligned electrospray device which may be the same as or similar to device 200 of FIG. 2.

Step 400 includes providing a silicon wafer 402 having a full thickness and may be substantially the same as processing step 300 of FIG. 3. The array of emitters of the device will be formed or otherwise provided from a portion of this wafer 402.

Step 410 includes disposing (e.g. depositing or otherwise providing), on the top surface of the silicon wafer 402, a layer of electrically insulating material 404, e.g. any of the electrically insulating materials described in connection with FIG. 2. Processing step 410 may be the same as or similar to processing step 310 describe above in conjunction with FIG. 3. However, in the embodiment of FIG. 4, no electrically conducting material is deposited at this time. In particular, the extractor is formed later, as described below.

Step 420 includes depositing, on the layer of electrically insulating material, a layer of photoresist 406 having an aperture pattern. Step 420 may be the same as or similar to step 320 described above in conjunction with FIG. 3.

Step 430 includes etching the aperture pattern through the deposited layers 406 and 404. This step produces the capillaries through which fluid will eventually traverse, and guarantees self-alignment of the emitters and the extractor apertures.

Step 440 includes depositing a layer of electrically conducting material 408 on the etched surface. This processing can include a non-conformal metal deposition. The extractor is formed on a top surface of the insulation layer 404 as a result of performing step 440, in manner which may be the same as or similar to the process described above in conjunction with FIG. 3. However, in contrast to FIG. 3, in the embodiment of FIG. 4 metal 409 is deposited at the bottom of each capillary.

Step 450 includes etching through the pattern substrate using a metal-assisted chemical etching (MACE) technique. The MACE technique requires that metal be deposited in each capillary and is enabled by processing step 440. Thus, the process of FIG. 4 includes two etching steps, similar to FIG. 3, however the second etching step differs between the two processes. The process used in any particular embodiment therefore may be chosen on the basis of cost, manufacturing processes available, or other external design factor.

Step 460 includes thinning the silicon wafer 402 through any residual electrically conducting material 411 to expose the emitters as the bottom surface of the silicon wafer 402. The thinning step 460 is complete when the emitters are exposed. Any thinning technique known in the art may be employed. However, unlike the thinning step 350 of FIG. 3, step 460 may first reveal residual electrical conducting material at the bottom of each capillary, and may be required to remove this material as well.

Step 470 includes undercutting the insulation layer to provide space for the Taylor cone to form in the gap between each emitter and its corresponding extractor aperture. Undercutting may be performed, for example, by oxidizing the insulation layer 404 and may use substantially the same techniques as processing step 360 of FIG. 3.

It is also appreciated that the processes of both FIGS. 3 and 4 define automatically align the extractor apertures with the emitters without the need for a separate two-wafer alignment process that is prone to misalignment errors. It is further appreciated that in both of these processes, the insulation layer is undercut only after the aforementioned self-alignment, ensuring that the alignment is not thereby affected. It is appreciated that in either case, the flow rate of embodiments may be controlled by varying the size of the extractor apertures.

In the foregoing detailed description, various features of embodiments are grouped together in one or more individual embodiments for the purpose of streamlining the disclosure. This method of disclosure is not to be interpreted as reflecting an intention that the claimed invention requires more features than are expressly recited in each claim. Rather, inventive aspects may lie in less than all features of each disclosed embodiment. It should also be appreciated that Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

Having described implementations which serve to illustrate various concepts, structures, and techniques which are the subject of this disclosure, it will now become apparent to those of ordinary skill in the art that other implementations incorporating these concepts, structures, and techniques may be used. Accordingly, it is submitted that that scope of the patent should not be limited to the described implementations but rather should be limited only by the spirit and scope of the following claims.

The invention claimed is:

1. A self-aligned electrospray device comprising:

a silicon wafer having a top surface and a bottom surface;

a layer of electrically insulating material deposited on the top surface of the silicon wafer;

a layer of electrically conducting material deposited on the layer of electrically insulating material, wherein the silicon wafer has through holes, the layer of electrically insulating material has through holes, the layer of electrically conducting material has through holes, and the electrically insulating layer is undercut, and wherein there is no misalignment between the through holes in the silicon wafer and corresponding ones of the through holes in both the layer of electrically insulating material and the layer of electrically conducting material;

a fluid reservoir, mounted to the bottom surface of the silicon wafer, for containing fluid; and a circuit, for providing an electric potential difference, coupled between the layer of electrically conducting material and the fluid reservoir.

2. The device of claim 1, wherein the insulating material comprises an oxide.

3. The device of claim 1, wherein the electrically conducting material comprises Tungsten (W).

4. The device of claim 1, wherein the electrically conducting material comprises a doped semiconductor material.

5. The device of claim 1, wherein the electrically conducting material comprises a conducting oxide.

6. The device of claim 1, wherein the through holes in the deposited layer of electrically conducting material have a diameter that is 15% to 25% larger than a dimeter of the through holes in the silicon wafer.

* * * * *